US005172636A

United States Patent [19]

Theurer et al.

[11] Patent Number: 5,172,636

[45] Date of Patent: Dec. 22, 1992

[54] BALLAST CLEANING MACHINE WITH PIVOTAL AND VARYING SPEED CONVEYORS FOR SELECTIVELY CONTROLLING CLEANED BALLAST DISTRIBUTION

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 806,869

[22] Filed: Dec. 12, 1991

[30] Foreign Application Priority Data

Feb. 12, 1991 [AT] Austria ..... 299/91

[51] Int. Cl.[5] ..... E01B 27/06

[52] U.S. Cl. ..... 104/2; 104/7.1; 171/16

[58] Field of Search ..... 104/2, 7.1; 171/16; 37/107

[56] References Cited

U.S. PATENT DOCUMENTS

| | | | |
|---|---|---|---|
| 3,685,589 | 8/1972 | Plasser et al. | 171/16 |
| 3,872,929 | 3/1975 | Theurer et al. | 104/2 X |
| 3,957,000 | 5/1976 | Plasser et al. | 104/2 X |
| 3,976,142 | 8/1976 | Plasser et al. | 104/2 X |
| 4,249,325 | 2/1981 | Theurer et al. | 104/2 X |
| 4,263,851 | 4/1981 | Theurer et al. | 104/2 X |
| 4,432,284 | 2/1984 | Theurer et al. | 104/2 X |
| 4,846,282 | 7/1989 | Cicin-Sain | 171/16 |

FOREIGN PATENT DOCUMENTS

| | | |
|---|---|---|
| 651869 | 1/1985 | Switzerland . |
| 2097846 | 11/1982 | United Kingdom . |

*Primary Examiner*—Douglas C. Butler
*Assistant Examiner*—S. Joseph Morano
*Attorney, Agent, or Firm*—Collard & Roe

[57] ABSTRACT

A mobile ballast cleaning machine comprises a machine frame, undercarriages supporting the machine frame for mobility on the track, an excavating chain mounted on the machine frame and arranged to excavate the ballast to expose the subgrade, a ballast screening installation arranged to receive the excavated ballast from the excavating chain and to clean the received ballast, a ballast conveyor unit extending in the longitudinal direction and having an input end receiving the cleaned ballast from the ballast screening installation and a discharge end, a chute arranged at the excavating chain for receiving the cleaned ballast from the discharge end of the ballast conveyor unit, the chute having at least one outlet opening, a conveyor band associated with each outlet opening for receiving the cleaned ballast from the outlet opening and having a discharge end for discharging the cleaned ballast on the exposed subgrade, a variable speed drive for operating each conveyor band to impart thereto a desired conveying speed, and a power-actuated, vertically and transversely adjustable track lifting device mounted on the machine frame.

12 Claims, 2 Drawing Sheets

IV
V
X 58
22
61
56
60
57
61
59
61
62
65
64
66

63
58
61
22

56
67
59
19
57
64
62
65

61
22

63
56
65
19
58
64
57
62

BALLAST CLEANING MACHINE WITH PIVOTAL AND VARYING SPEED CONVEYORS FOR SELECTIVELY CONTROLLING CLEANED BALLAST DISTRIBUTION

BACKGROUND OF THE INVENTION

1. Field of the Invention

The present invention relates to a mobile ballast cleaning machine for continuously receiving ballast from a ballast bed supported on a subgrade and supporting a track having two rails, and for cleaning the received ballast, which comprises a machine frame extending in a longitudinal direction along the track, undercarriages supporting the machine frame for mobility on the track in an operating direction, an excavating chain mounted on the machine frame and arranged to excavate the ballast to expose the subgrade, a ballast screening installation arranged to receive the excavated ballast from the excavating chain and to clean the received ballast, a ballast conveyor unit extending in the longitudinal direction and having an input end receiving the cleaned ballast from the ballast screening installation and a discharge end, a chute arranged at the excavating chain for receiving the cleaned ballast from the discharge end of the ballast conveyor unit, the chute having at least one outlet opening, and a power-actuated, vertically and transversely adjustable track lifting device mounted on the machine frame.

2. Description of the Prior Art

Such ballast cleaning machines are very well known, as exemplified by Swiss patent No. 651,869, published Oct. 15, 1985. In this ballast cleaning machine, the cleaned ballast is conveyed to a ballast distributing device arranged in the range of the ballast excavating chain, two ballast discharge chutes positioned one behind the other in the longitudinal direction of the machine being associated with the ballast distributing device. The ballast distributing device is equipped with a controllable distributing baffle enabling a predetermined amount of cleaned ballast to be deflected to the rear or the front chute, depending on the depth of excavation and the desired depth of the redistributed cleaned ballast layer. The cleaned ballast deflected into the front chute is discharged directly behind the excavating chain on the exposed subgrade and is planed and compacted with an adjacent ballast compacting device. The cleaned ballast portion deflected into the rear chute is discharged therefrom onto a ballast distributing conveyor band extending in the longitudinal direction and conveying this portion of the cleaned ballast to a point immediately in front of the rearmost undercarriage of the machine where it is thrown into the cribs. This arrangement has the disadvantage that the amount of cleaned ballast to be distributed cannot be accurately metered.

U.S. Pat. No. 3,685,589, dated Aug. 22, 1972, discloses a ballast cleaning machine in which the cleaned ballast distributing device comprises a storage bin for the cleaned ballast arranged immediately behind the excavating chain for discharging controlled amounts of cleaned ballast on the exposed subgrade behind the excavating chain, a chute arranged immediately in front of the rear undercarriage of the machine for discharging controlled amounts of cleaned ballast into the cribs, and two cleaned ballast conveyors extending in the longitudinal direction of the machine above the track rails and being transversely pivotal about respective vertical axes for controllably conveying cleaned ballast to the rear chute or the front storage bin.

British patent No. 2,097,846, published Apr. 3, 1985, discloses a ballast cleaning machine in which the cleaned ballast is conveyed for discharge on the exposed subgrade behind the excavating chain by a conveyor unit extending in the longitudinal direction of the machine between the screening installation and the excavating chain.

SUMMARY OF THE INVENTION

It is the primary object of this invention to improve a ballast cleaning machine of the first-described type so that the distributed cleaned ballast may be more accurately metered, which will provide a more even cleaned ballast bed for support of the track In a mobile ballast cleaning machine for continuously receiving ballast from a ballast bed supported on a subgrade and supporting a track having two rails, and for cleaning the received ballast, which comprises a machine frame extending in a longitudinal direction along the track, undercarriages supporting the machine frame for mobility on the track in an operating direction, an excavating chain mounted on the machine frame and arranged to excavate the ballast to expose the subgrade, a ballast screening installation arranged to receive the excavated ballast from the excavating chain and to clean the received ballast, a ballast conveyor unit extending in the longitudinal direction and having an input end receiving the cleaned ballast from the ballast screening installation and a discharge end, a chute arranged at the excavating chain for receiving the cleaned ballast from the discharge end of the ballast conveyor unit, the chute having at least one outlet opening, and a power-actuated, vertically and transversely adjustable track lifting device mounted on the machine frame, the above and other objects and advantages are accomplished according to the invention by providing a conveyor band associated with each outlet opening for receiving the cleaned ballast from the outlet opening and having a discharge end for discharging the cleaned ballast on the exposed subgrade, and a variable speed drive for operating each conveyor band to impart thereto a desired conveying speed.

This novel arrangement enables the amounts of cleaned ballast discharged from the conveyor band to be metered substantially independently of the usually irregular amounts of cleaned ballast conveyed by the conveyor unit to the cleaned ballast discharge chute. In this way, a ballast bed of uniform depth may be produced according to a track plan. Since each outlet opening of the discharge chute has its own conveyor band, the conveyor bands may be used also to interrupt the discharge of cleaned ballast from the outlet openings for a brief time by simply stopping the conveyor band so that the conveyor bands also serve as closures for the chute outlet openings. This is of particular advantage when, for example, a ballast accumulation destroying the evenness of the ballast bed would occur when the forward movement of the machine is suddenly stopped.

If two such conveyor bands are transversely spaced from each other in a horizontal plane and respectively extend in the longitudinal direction above the track rails, their drives may be operated at different speeds to discharge differently selected amounts of cleaned ballast in each half of the track bed. This is of great advantage in track curves having a substantial superelevation.

Generally, the arrangement according to the present invention provides a more accurate positioning of the track on the cleaned ballast bed and thus simplifies the subsequent tamping operation.

According to a preferred feature of this invention, each conveyor band is pivotal about a vertical center axis of the associated outlet opening of the chute, and a respective pivoting drive is connected to each conveyor band. This enables the amount of discharged cleaned ballast to be varied at the gage and field sides of each rail by pivoting the conveyor bands to a small extent about the vertical axes. It is also possible to pivot the conveyor bands instantly by 90° at a sudden stop of the machine so that the cleaned ballast is discharged on the shoulders rather than causing an unwanted accumulation of cleaned ballast under the track.

Unhindered pivoting of the conveyor band about the vertical axis will be possible in a simple structure if the conveyor band is affixed to the chute adjacent the associated outlet opening.

According to another feature, a carrier frame for the chute extends in the longitudinal direction and centers at least an upper part of the chute on the machine frame. In this way, if only a single conveyor unit for the cleaned ballast is used, the machine frame may be quite narrow so that the excavating chain may be arranged without problems within the railway loading gage during transit.

If the ballast cleaning machine comprises two conveyor bands transversely spaced from each other in a horizontal plane and respectively extending in the longitudinal direction above the track rails, a respective cleaned ballast distributing device may have an inlet opening arranged to receive the cleaned ballast from the discharge end of each conveyor band and two discharge openings arranged adjacent each other in a direction extending transversely to the track. This arrangement will protect the rail fastening elements, on the one hand, and will provide a concentrated discharge of the cleaned ballast at the points of support for the two rails, on the other hand.

The track lifting device is arranged immediately rearwardly of the discharge ends of the conveyor bands, and each cleaned ballast distributing device may be affixed to the track lifting device. This will enable the conveyor bands to be transversely pivoted unhindered and, at the same time, the cleaned ballast distributing device will be automatically centered above the two track rails when the track lifting device is lowered.

Preferably, a respective tunnel element extends over each track rail and each cleaned ballast distributing device comprises an end wall connected to the track lifting device and to a respective one of the tunnel elements, each end wall extending transversely to the longitudinal direction and having opposite ends transversely spaced from each other, and a respective side wall hinged to a respective one of the opposite end wall ends and pivotal about a vertical axis. Elastic wiper elements may be mounted at the lower ends of the side walls. The side walls are preferably selectively adjustable into respective pivotal positions and are retainable in the adjusted positions. The conveyor band may be an endless conveyor band having a lower course spaced a predetermined distance from an upper edge of the track rail above which it extends, and the end wall of each cleaned ballast distributing device has a height corresponding at least to said distance. With such a cleaned ballast distributing device, the cleaned ballast discharged from the conveyor band may be briefly stored on the track ties or it may be permitted to impact the end wall. In either case, depending on the position of the distributing device with respect to the track, the cleaned ballast will fall vertically between the ties onto the subgrade and an improved ballast distribution will thus be advantageously obtained below the track. This is in contrast to conventional arrangements of cleaned ballast distributing devices in which the conveyor bands throw the cleaned ballast in a curved discharge path extending obliquely to the track plane, which reduces the crib between the ties and makes the discharge of the cleaned ballast under the ties more difficult. By pivoting the side walls hinged to the end wall, the width of the ballast supports for the track rails may be readily varied, and it is also possible to pivot the field side wall so that any excess ballast may be discharged on the shoulder if there is a sudden excess of cleaned ballast discharged from the conveyor band. The elastic wiper elements at the lower ends of the side walls will automatically remove ballast from the ties.

The chute preferably has four outlet openings arranged adjacent each other in a direction extending transversely to the track, a respective one of the conveyor bands being associated with each outlet opening. This enables the depth of the discharged cleaned ballast across the entire ballast bed to be conformed accurately to the requirements of a track plan by dividing the discharge into four adjacent zones.

Finally, an operating control may be provided for each pivoting drive for automatically actuating the drive in response to an interruption of the forward movement of the machine along the track to pivot the conveyor band connected to the drive into a position wherein the conveyor band extends perpendicularly to the longitudinal direction. This will assure that no excess cleaned ballast is accumulated under the track during a brief stop of the machine.

BRIEF DESCRIPTION OF THE DRAWING

The above and other objects, advantages and features of the present invention will become more apparent from the following detailed description of certain now preferred embodiments thereof, taken in conjunction with the somewhat schematic accompanying drawing wherein.

DETAILED DESCRIPTION OF PREFERRED EMBODIMENTS

Figures 1, 2, 3, 4, 5, 6:
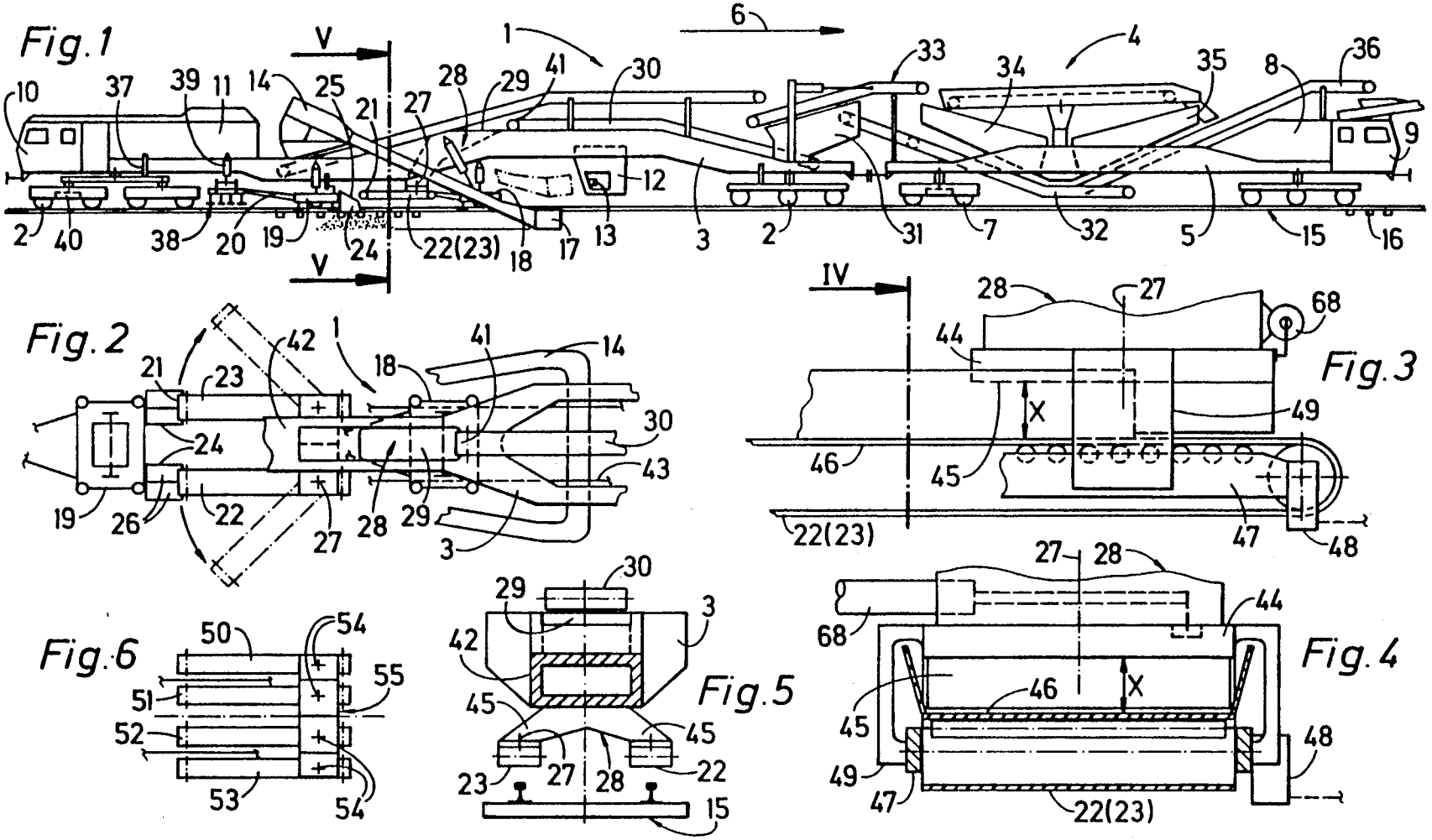
FIG. 1 is a side elevational view of a mobile ballast cleaning machine incorporating the cleaned ballast distributing device of this invention.
FIG. 2 is an enlarged and fragmentary top view showing the cleaned ballast distributing device of the machine of FIG. 1.
FIG. 3 is an enlarged and fragmentary side view showing the discharge conveyor band affixed to the chute.
FIG. 4 is a transverse cross section along line IV of FIG. 3.
FIG. 5 is an enlarged and fragmentary cross section along line V—V of FIG. 1, showing the mounting of the chute.
FIG. 6 is a top view diagrammatically showing another embodiment of the chute with four adjacent outlet openings and associated conveyor bands.

Referring now to the drawing and first to FIGS. 1 and 2, there is shown mobile ballast cleaning machine 1 for continuously receiving ballast from a ballast bed supported on a subgrade and supporting a track 15 having two rails 43, 43 fastened to ties 16, and for cleaning the received ballast. The machine comprises first machine frame 3 extending in a longitudinal direction along the track, undercarriages 2, 2 supporting machine frame 3 for mobility on track 15 in an operating direction indicated by arrow 6, and excavating chain 14 mounted on the machine frame and arranged to excavate the ballast to expose the subgrade. Ballast cleaning machine 1 further comprises second machine frame 5 detachably coupled to machine frame 3 and preceding the first machine frame in the operating direction, the second machine frame being supported on track 15 by undercarriages 7, 7. The front end of machine 1 carries engineer's cab 9 and power plant 8 mounted on second machine frame 5 while the rear end of the ballast cleaning machine carries engineer's cab 10 and power plant 11 mounted on first machine frame 3. The power plants provide energy to the various operating drives of the machine. First machine frame 3 has an upwardly recessed center portion carrying operator's cab 12 which houses control panel 13.

Excavating chain 14 is a conventional, power-driven endless ballast excavating chain vertically adjustably linked to machine frame 3 and comprising a transverse course 17 within view, and rearwardly, of operator's cab 12, which excavating chain course extends transversely to, and under, track 15 to excavate the ballast and expose the subgrade. Power-actuated, vertically and transversely adjustable track lifting device 18 is mounted on machine frame 3 immediately behind transverse excavating chain course 17. A further power-actuated, vertically and transversely adjustable track lifting device 19 is mounted on machine frame 3 between track lifting device 18 and rear undercarriage 2. A hydraulically operated vibrator is arranged to impart to track lifting device 19 horizontal oscillations extending transversely to track 15. This vibrator and its operation is more fully described and claimed in our concurrently filed application Ser. No. 07/806,870 entitled "Ballast Cleaning Machine". Longitudinally extending carrier 20 links track lifting device 19 to machine frame 3.

A ballast screening installation comprised of twin ballast screens 34, 35 is arranged on second machine frame 5 to receive the excavated ballast from excavating chain 14 and to clean the received ballast, and ballast conveyor unit 30 extends in the longitudinal direction and has an input end consisting of conveyor band 32 receiving the cleaned ballast from the ballast screening installation and discharge end 41. The two ballast screens have separate drives for independently vibrating the screens. Overhead conveyor unit 33 comprised of three successively arranged conveyor bands conveys the encrusted ballast excavated by endless chain 14 to one and/or the other ballast cleaning screen 34, 35, and the vibratory screens separate the ballast into a cleaned ballast portion and rubble which is removed by conveyor unit 36. The cleaned ballast is conveyed by input conveyor band 32 into storage bin 31 whence it is conveyed to discharge end 41. Chute 28 is arranged at excavating chain 14 for receiving the cleaned ballast from discharge end 41 of ballast conveyor unit 30 and has two outlet openings 45 in the embodiment illustrated in FIGS. 1 to 5. A conveyor band 22, 23 is associated with each outlet opening 45 for receiving the cleaned ballast from the outlet opening and has discharge end 21 for discharging the cleaned ballast on the exposed subgrade immediately in front of track lifting device 19 in the operating direction. Variable speed drive 48 is connected to each conveyor band 22, 23 for operating each conveyor band to impart thereto a desired conveying speed. Conveyor bands 22, 23 are transversely spaced from each other in a horizontal plane and respectively extend in the longitudinal direction above track rails 43, and each conveyor band is pivotal at its front end about vertical center axis 27 of associated outlet opening 45 of chute 28. A respective pivoting drive 68 is connected to each conveyor band 22, 23.

As shown in FIGS. 3 to 5, each conveyor band 22, 23 is affixed to chute 28 adjacent the associated outlet opening 45. In the illustrated embodiment, rotary mount or turntable 44 connects the conveyor band to the chute at the outlet opening. The outlet opening has a height X and is delimited at the bottom by upper course 46 of endless conveyor band 22, 23 and at the top by the underside of rotary mount 44. Carrier frame 47 for the conveyor band is attached to the rotary mount by connecting brackets 49. Variable speed drive 48 enables the conveying speed of the conveyor band to be steplessly controlled.

As shown in FIG. 2, conveyor unit 30 extends on machine frame 3 in the longitudinal direction centrally between track rails 43. Discharge end 41 of the conveyor unit is arranged above input opening 29 of chute 28. A carrier frame 42 for chute 45 extends centrally in the longitudinal direction and forms a part of machine frame 3 to center an upper part of the chute on the machine frame. A respective cleaned ballast distributing device 24 disposed between discharge end 21 of each conveyor band 22, 23 and track lifting device 19 has inlet opening 25 arranged to receive the cleaned ballast from the discharge end of each conveyor band and two discharge openings 26 arranged adjacent each other in a direction extending transversely to the track and above each rail. Track lifting device 19 is arranged immediately rearwardly of discharge ends 21 of the conveyor bands, and each cleaned ballast distributing device 24 is affixed to the track lifting device.

As diagrammatically shown in FIG. 6, it is also possible for chute 55 to have four outlet openings arranged adjacent each other in a direction extending transversely to the track, a respective conveyor band 50, 51, 52, 53 being associated with each outlet opening. Each conveyor band is independently pivotal about vertical axis 54 and has its own pivoting drive.

The vertical adjustment of excavating chain 14 and track lifting device 19 is controlled by reference system 37 forming part of ballast cleaning machine 1. This control forms no part of the invention and a level measuring system useful for the machine of the present invention has been described and claimed in U.S. Pat. No. 4,432,284, dated Feb. 21, 1984. It will, therefore, not be described herein. A tamping head 38 is mounted on each side of the machine immediately preceding rear undercarriage 2 and each tamping head is equipped with vertically adjustable tamping plates extending in the longitudinal direction and pivotal about an axis extending in the longitudinal direction. Drive 40 enables the machine to be continuously moved forward in the operating direction during the ballast excavating, cleaning and redistributing operation.

Figure 7:
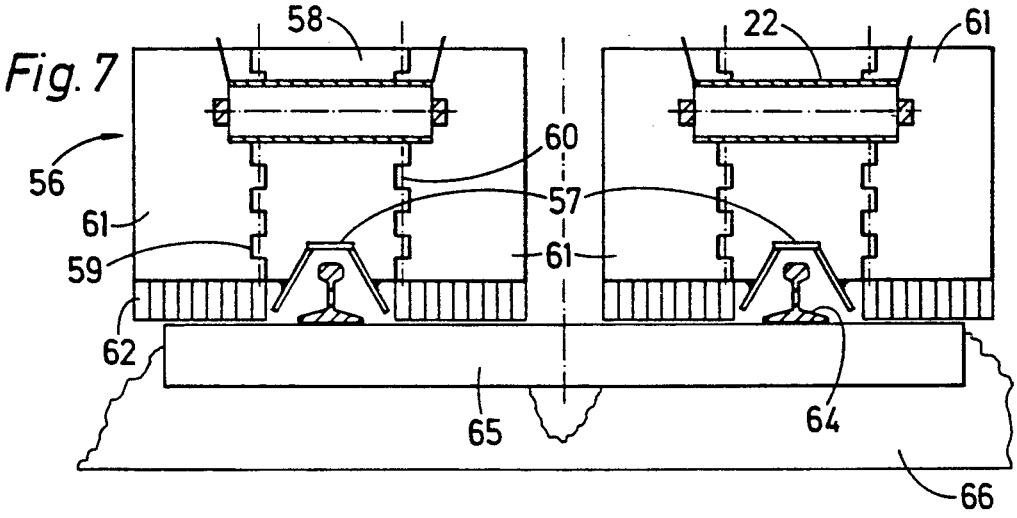
FIG. 7 is a transverse cross section showing a preferred embodiment of two transversely spaced cleaned ballast distributing chutes and their associated ballast discharge conveyor bands.
Figure 8:
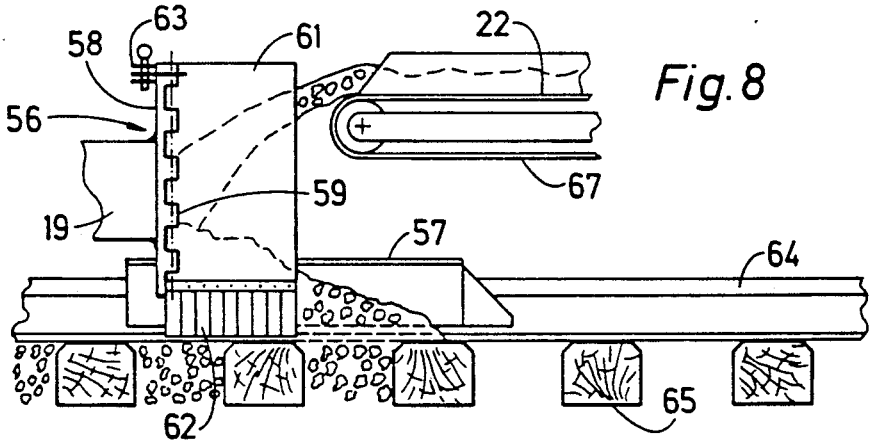
FIGS. 8 and 9 are side and top views, respectively, of the ballast discharge chute and conveyor band associated with each rail.
Figure 9:
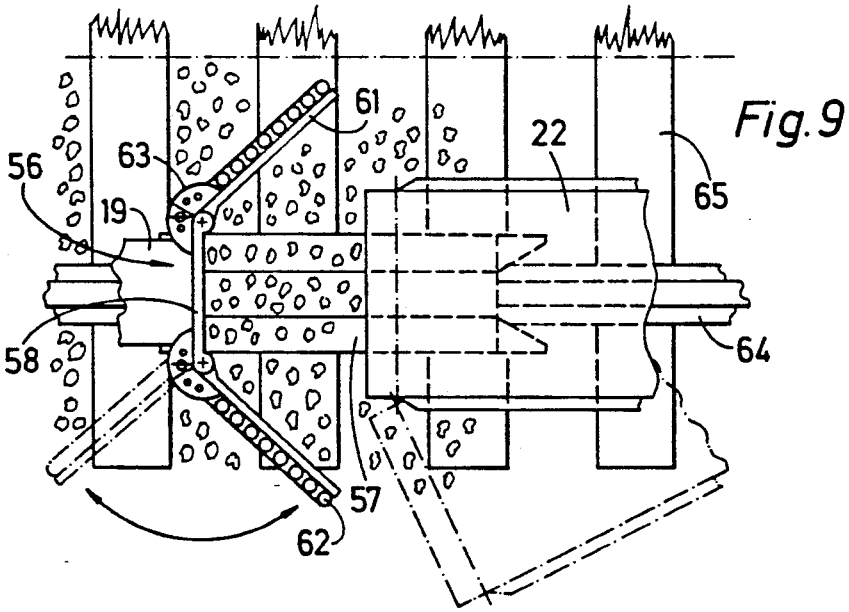

In the embodiment of ballast distributing device 56 shown in FIGS. 7 to 9, a respective tunnel element 57 extends over each track rail 64 to cover the rail and to deflect distributed cleaned ballast from the rail. Each cleaned ballast distributing device 56 comprises end wall 58 connected to track lifting device 19 (see FIGS. 8 and 9) and to a respective one of tunnel elements 57. Each end wall 58 extends transversely to the longitudinal direction and has opposite ends transversely spaced from each other, and a respective side wall 61 is hinged by hinge 59 to a respective one of the opposite end wall ends and is pivotal about vertical axis 60. The side walls are selectively adjustable into respective pivotal positions and are retainable in the adjusted positions by a blocking device 63 including a bolt insertable into selected holes in retaining plates attached to the end and side walls (see FIG. 9). As best shown in FIG. 9, the width of the cleaned ballast support for each rail 57 provided by the distribution of the cleaned ballast by device 56 may be varied by adjusting the angle between end wall 58 and side walls 61. If conveyor band 22 delivers an excess amount of cleaned ballast, field side wall 61 may be pivoted into a position (see phantom lines in FIG. 9) enabling the excess cleaned ballast to flow freely to the track shoulder.

A multiplicity of elastic wiper elements 62 are provided at the lower ends of side walls 61. The elastic wiper elements are in contact with the upper face of tie 65 to which track rails 57 are fastened when cleaned ballast distributing device 56 has been lowered into its operating position. Tie 65 rests on ballast bed 66. Any pivoting movement of the field side wall 61 will cause wiper elements 62 to sweep any ballast from the upper surface of the tie.

As best shown in FIG. 8, each conveyor band is an endless conveyor band having a lower course 67 spaced a predetermined distance from an upper edge of track rail 64 above which it extends, and end wall 58 of each cleaned ballast distributing device 56 has a height exceeding this distance.

Ballast cleaning machine 1 operates in the following manner:

While the machine continuously advances along track 15 in the operating direction indicated by arrow 6, endless excavating chain 14 is operated to excavate the dirty and encrusted ballast underneath the track to expose the subgrade, and the excavated ballast is conveyed by overhead conveyor arrangement 33 to vibratory ballast cleaning screens 34, 35 in which the dirt and rubble is separated from the cleaned ballast. The cleaned ballast is conveyed by input conveyor band 32 to storage bin 31 whence it is further conveyed by conveyor band 30 to discharge end 41 of this conveyor unit, which discharges the cleaned ballast into chute 28. The cleaned ballast then falls through outlet openings 45 of the chute onto conveyor bands 22, 23 extending above each track rail 43. The conveyor bands convey the cleaned ballast to ballast distributing devices 24 which distribute the cleaned ballast over the exposed subgrade.

During the entire operation, it is advantageous to keep chute 28 at least partly filled with cleaned ballast. For this purpose, the chute is equipped with conventional instruments indicating the level of ballast in the chute. In this way and since the size of chute outlet opening 45 is predetermined, a cleaned ballast layer of uniform height will always be deposited from the outlet opening on the associated conveyor band 22, 23 as long as the conveying speed of the conveyor band remains constant. To change the amount of cleaned ballast on the conveyor bands, the speed of their steplessly variable speed drives 48 is changed. In this way, an operator in cab 12 within view of the cleaned ballast discharge site or an operator within view of a video screen receiving a video picture of this site may readily control the amount of discharged cleaned ballast at each side of track 15. If the ballast cleaning machine is suddenly stopped for some reason, drives 48 may be stopped to interrupt further conveyance of cleaned ballast to distributing devices 24, 56 so that conveyor bands 22, 23 operate as closures for outlet openings 45. In this case, conveyor 30 will also be stopped and the cleaned ballast coming from ballast cleaning screens 34, 35 will be stored in storage bin 31. Alternatively and instead of discontinuing the operation of conveyor bands 22, 23 when the advance of machine 1 is briefly interrupted, pivoting drives 68 may be operated to pivot the conveyor bands outwardly (see phantom lines in FIG. 2) so that the cleaned ballast will be distributed on the shoulder.

Immediately behind the cleaned ballast distributing devices in the operating direction, track lifting device 19 will continually impart horizontal, transversely extending oscillations to the track while, at the same time, lowering the track to a uniform level determined by reference system 37. The vibrating track lowered into the cleaned ballast bed will enhance the flow of the distributed ballast and will compact the same. The necessary vertical load required for the controlled lowering of track 15 is generated by hydraulic drives linking the track lifting device to machine frame 3. The track level controlled by track lifting device 19 is secured by the operation of the two tamping heads 38, which are transversely spaced from each other and whose tamping tools at the opposite ends of the ties will tamp the cleaned ballast under the track. For this purpose, the tamping tools are immersed in the shoulder ballast and they are operated to shovel the lowest layer of the shoulder ballast up to the area adjacent the tie ends where the ballast is compacted by pressing it under the ties. The tamping tools are then slightly raised and are again pivoted laterally outwardly and into the lowest layer of the shoulder ballast in a cyclically repeated elliptical pivoting motion of the tamping plates. This tamping of the cleaned ballast at the opposite ends of the ties will considerably improve the resistance of track 15 to transverse displacement.

What is claimed is:

1. A mobile ballast cleaning machine for continuously receiving ballast from a ballast bed supported on a subgrade and supporting a track having two rails, and for cleaning the received ballast, which comprises (a) a machine frame extending in longitudinal direction along the track, (b) undercarriages supporting the machine frame for mobility on the track in an operating direction, (c) an excavating chain mounted on the machine frame and arranged to excavate the ballast to expose the subgrade, (d) a ballast screening installation arranged to receive the excavated ballast from the excavating chain and to clean the received ballast, (e) a ballast conveyor unit extending in the longitudinal direction and having an input end receiving the cleaned ballast from the ballast screening installation and a discharge end, (f) a chute arranged at the excavating chain for receiving the cleaned ballast from the discharge end of the ballast conveyor unit, the chute having (1) at least one outlet opening in a bottom thereof, (g) a conveyor band mounted immediately below, and having one end delimiting, each bottom outlet opening for receiving the cleaned ballast from the bottom outlet opening and having a discharge end for discharging the cleaned ballast on the exposed subgrade, (1) the conveyor band being pivotal about a vertical center axis of the bottom outlet opening of the chute, (h) a pivoting drive connected to the conveyor band, (i) a variable speed drive for operating each conveyor band to impart thereof selectively a desired conveying speed for discharging a desired amount of the cleaned ballast from the discharge end or to close the bottom outlet opening by the one conveyor band end upon stoppage of the drive, and (k) a power-actuated, vertically and transversely adjustable track lifting device mounted on the machine frame.

2. The ballast cleaning machine of claim 1, wherein the conveyor band is affixed to the chute adjacent the bottom outlet opening.

3. The ballast cleaning machine of claim 1, wherein a carrier frame for the chute extends in the longitudinal direction and centers at least an upper part of the chute on the machine frame.

4. The ballast cleaning machine of claim 1, comprising two of said conveyor bands, the two conveyor bands being transversely spaced from each other in a horizontal plane and respectively extending in the longitudinal direction above the track rails, a respective cleaned ballast distributing device having an inlet opening arranged to receive the cleaned ballast from the discharge end of each conveyor band and two discharge openings arranged adjacent each other in a direction extending transversely to the track.

5. The ballast cleaning machine of claim 4, wherein the track lifting device is arranged immediately rearwardly of the discharge ends of the conveyor bands, and each cleaned ballast distributing device is affixed to the track lifting device.

6. The ballast cleaning machine of claim 5, further comprising a respective tunnel element extending over each track rail, and each cleaned ballast distributing device comprising an end wall connected to the track lifting device and to a respective one of the tunnel elements, each end wall extending transversely to the longitudinal direction and having opposite ends transversely spaced from each other, and a respective side wall hinged to a respective one of the opposite end wall ends and pivotal about a vertical axis.

7. The ballast cleaning machine of claim 6, further comprising elastic wiper elements at the lower ends of the side walls.

8. The ballast cleaning machine of claim 6, wherein the side walls are selectively adjustable into respective pivotal positions and are retainable in the adjusted positions.

9. The ballast cleaning machine of claim 6, wherein each conveyor band is an endless conveyor band having a lower course spaced a predetermined distance from an upper edge of the track rail above which it extends, and the end wall of each cleaned ballast distributing device has a height corresponding at least to said distance.

10. The ballast cleaning machine of claim 1, wherein the chute has four of said outlet openings arranged adjacent each other in a direction extending transversely to the track, a respective one of the conveyor bands being associated with each outlet opening.

11. The ballast cleaning machine of claim 1, further comprising an operating control for the pivoting drive for automatically actuating the drive in response to an interruption of the forward movement of the machine along the track to pivot the conveyor band connected to the drive into a position wherein the conveyor band extends perpendicularly to the longitudinal direction.

12. The ballast cleaning machine of claim 1, wherein the chute has two of said outlet openings in the bottom thereof, the bottom outlet openings being transversely spaced from each other, and two of said conveyor bands are transversely spaced from each other in a horizontal plane and respectively extend in the longitudinal direction above the track rails.

* * * * *